US011166552B1

(12) United States Patent
Minsky

(10) Patent No.: US 11,166,552 B1
(45) Date of Patent: Nov. 9, 2021

(54) POP-UP DISPLAY APPARATUS

(71) Applicant: Richard Minsky, Hudson, NY (US)

(72) Inventor: Richard Minsky, Hudson, NY (US)

( * ) Notice: Subject to any disclaimer, the term of this patent is extended or adjusted under 35 U.S.C. 154(b) by 0 days.

(21) Appl. No.: 17/231,158

(22) Filed: Apr. 15, 2021

Related U.S. Application Data

(60) Provisional application No. 62/704,250, filed on Apr. 30, 2020.

(51) Int. Cl.
*A47B 97/08* (2006.01)

(52) U.S. Cl.
CPC ..... *A47B 97/08* (2013.01)

(58) Field of Classification Search
CPC ..... A47B 97/08; A47B 19/06; A47B 19/08; B65D 5/5206; B65D 5/5213
See application file for complete search history.

(56) References Cited

U.S. PATENT DOCUMENTS 2,504,270 A 12/1881 Dobriner
1,040,066 A * 10/1912 Washburn ..... A47B 97/08 248/449
1,700,824 A * 2/1929 Harden ..... B65D 5/5206 206/45.23
1,811,164 A 6/1931 Wilson
1,859,049 A 5/1932 Poppe
1,859,401 A 5/1932 Lengfield
2,657,793 A 11/1953 Goldshine
2,680,512 A 6/1954 Young
2,808,680 A * 10/1957 Bereth ..... A47B 19/08 190/11
2,813,621 A 11/1957 Parker
2,934,388 A * 4/1960 Brown ..... A45C 9/00 312/233
3,824,706 A 7/1974 Scopa
4,318,471 A * 3/1982 Hutton ..... A47B 97/08 206/214
4,896,766 A 1/1990 Paley
4,917,980 A 4/1990 Badesha et al.
5,096,055 A 5/1992 Opper
(Continued)

OTHER PUBLICATIONS

"Hugo Feller's Pop-up Box Workshop; The Book", May 1990, Jack Fritterer, 14pgs, Retrieved from Internet: <http://www.philobiblon.com/Fitterer-PellerBox.pdf>.

(Continued)

*Primary Examiner* — Matthew W Ing
(74) *Attorney, Agent, or Firm* — Troutman Pepper Hamilton Sanders LLP

(57) ABSTRACT

Display apparatuses are disclosed that store object(s) and operate to become a display stand for the object(s) without requiring contact with the object(s). A top is coupled to a bottom via a top hinge. The top includes a top rear side coupled to a front cover via a front cover hinge. The bottom includes a back cover coupled to bottom sides. An easel is disposed within the bottom sides and coupled to a bottom front side via an easel hinge. A strut is coupled to the bottom via a strut hinge. A strut tether is coupled to the strut and an interior surface of the front cover. The strut is configured to rotate about the strut hinge, to cause the easel to raise by rotating about the easel hinge, when the top is rotated about the top hinge and the front cover is rotated about the front cover hinge.

20 Claims, 6 Drawing Sheets

(56) References Cited

U.S. PATENT DOCUMENTS

| | | | | |
|---|---|---|---|---|
| 6,231,023 | B1 * | 5/2001 | Morton | A47B 97/08 248/441.1 |
| 10,517,391 | B1 * | 12/2019 | Fischer | A47B 23/043 |
| 2013/0126593 | A1 * | 5/2013 | Mandreucci | B65D 51/24 229/125 |

OTHER PUBLICATIONS

Rideout et al., "Collapsible Book Cradle", The Preservation Lab, Aug. 27, 2014, pp. 1-6, Retrieved from Internet: <https://drive.google.com/file/d/0B48Ymle734XGdjBqb1IHV0tQZHM/view>.

"INSTEN Hot Pink Leather Tablet Case Cover with Stand for Apple iPad Mini ½ Retina Display", Mar. 4, 2021, Overstock.com, 3pgs, Retrieved from the Internet:<https://www.overstock.com/Electronics/INSTEN-Hot-Pink-Leather-Tablet-Case-Cover-with-Stand-for-Apple-iPad-Mini-1-2-Retina-Display/7595655/product.html>.

Targus Pro-Tek Case for iPad Mini (5th gen.), iPad mini 4, 3, 2 and iPad Mini (Black), Mar. 4, 2021, Overstock.com, 3pgs, Retrieved from Internet:<https://www.overstock.com/Electronics/Targus-Pro-Tek-Case-for-iPad-mini-5th-gen.-iPadmini-4-3-2-and-iPad-mini-Black/28901098/product.html>.

"All New iPad Pro 12.9 inch case, SUPCASE, Unicom Beetle PRO Series Full-body Rugged Protective Case", Mar. 4, 2021, Overstock.com, 3pgs, Retrieved from the Internet: <https://www.overstock.com/Electronics/All-New-iPad-Pro-12.9-inch-case-SUPCASE-Unicorn-Beetle-PRO-Series-Full-body-Rugged-Protective-Case/16774575/product.html>.

"Insten for Apple iPhone 6 Plus/6s Plus/7 Plus/8 Plus Red Gentleman Leather Case Cover", Mar. 4, 2021, Overstock.com, 3pgs, Retrived from Internet:<https://www.overstock.com/Electronics/Insten-For-Apple-iPhone-6-Plus-6s-Plus-7-Plus-8-Plus-Red-Gentleman-Leather-Case-Cover/26377515/product.html>.

"YAGGER Easel Stand Adjustable Tabletop Easel, Portable Tabletop Easel, Multi-Function Wooden Box Easel or Art Display Painting HUAJI", Mar. 4, 2021, Amazon.com, 4pgs, Retrieved from Internet: <https://www.amazon.com/YAGEER-Adjustable-Tabletop-Portable-Multi-Function/dp/B07Z46G7D7>.

"US Art Supply Solana Adjustable Wood Desk Easel with Drawers Painting Art", Walmart.com, 12pgs, Retrieved from Internet: <https://www.walmart.com/ip/US-Art-Supply-Solana-Adjustable-Wood-Desk-Easel-with-Drawers-Painting-Art/41171831>.

"Delux Box Table Easel by Artist's Loft ®", Michael's.com, Mar. 4, 2021, 3pgs, Retrieved from Internet: <https://www.michaels.com/deluxe-table-easel-by-artists-loft/10132811.html>.

"Portable and Foldable Bamboo Book Stand for Tabletop Book Display and iPad Holder", Xiamen Forever Rise Imp and Exp Co., Ltd, 5pgs, Mar. 4, 2021, Retrieved from Internet: <https://m.made-in-china.com/product/Portable-and-Foldable-Bamboo-Book-Stand-for-Tabletop-Book-Display-and-iPad-Holder-853914805.html>.

"Pop-Up Book Display Case", iDisplayit.com, Mar. 4, 2021, 3pgs, Retrieved from Internet: < https://www.idisplayit.co.uk/us/display-cases-for-lego/ideas/21315-popup-book-display-case-closed/>.

"Portable Presentation Lecterns", Podiums Direct Cooperation, Mar. 4, 2021, 9pgs, Retrieved from Internet: < https://podiumsdirect.com/collections/portable-presentation-lecterns>.

"40' Tall Folding Magazine Rack with 3 Literature Pockets—Black", Displays2Go, 6pgs, Retrieved from Internet: <https://www.displays2go.com/P-24609/Folding-Literature-Counter-with-Locking-Carrying-Case>.

"Drop Spine Cradle Box", Peaky Conservation Book Conservation, Oct. 27, 2009, 8pgs, Retrieved from Internet: <https://jeffpeachey.com/2009/10/27/drop-spine-box-with-an-integral-cradle/>.

* cited by examiner

POP-UP DISPLAY APPARATUS

This application claims the benefit of U.S. Provisional Patent Application Ser. No. 62/704,250, filed Apr. 30, 2020, which is hereby incorporated by reference in its entirety.

FIELD

This technology generally relates to display stands, easels, or lecterns and, more particularly, to pop-up display apparatuses (e.g., boxes) that more efficiently facilitate display of objects stored therein and/or integral therewith.

BACKGROUND

Display stands, lecterns, and easels, collectively referred to herein as "easels," are often used to display objects, such as books, paint canvases, and other artwork, for example. Many objects are difficult to both store and present, such as rare and/or antique books. In particular, such objects may appear better in certain display angles based on ambient lighting. However, current easels often only have one display angle or are difficult to operably enable different angles of display.

Additionally, current easels either do not facilitate storage of any objects, are incapable of storing the objects intended to be displayed by the easels, and/or do not store such objects in an effective manner to facilitate protection or preservation. Moreover, contact with the objects to be displayed is generally required for presentation by current easels, which may be harmful to the objects. Other current easels are difficult to operate, setup, and/or assemble (e.g., from parts maintained in a box or other container).

DETAILED DESCRIPTION

Figure 1:
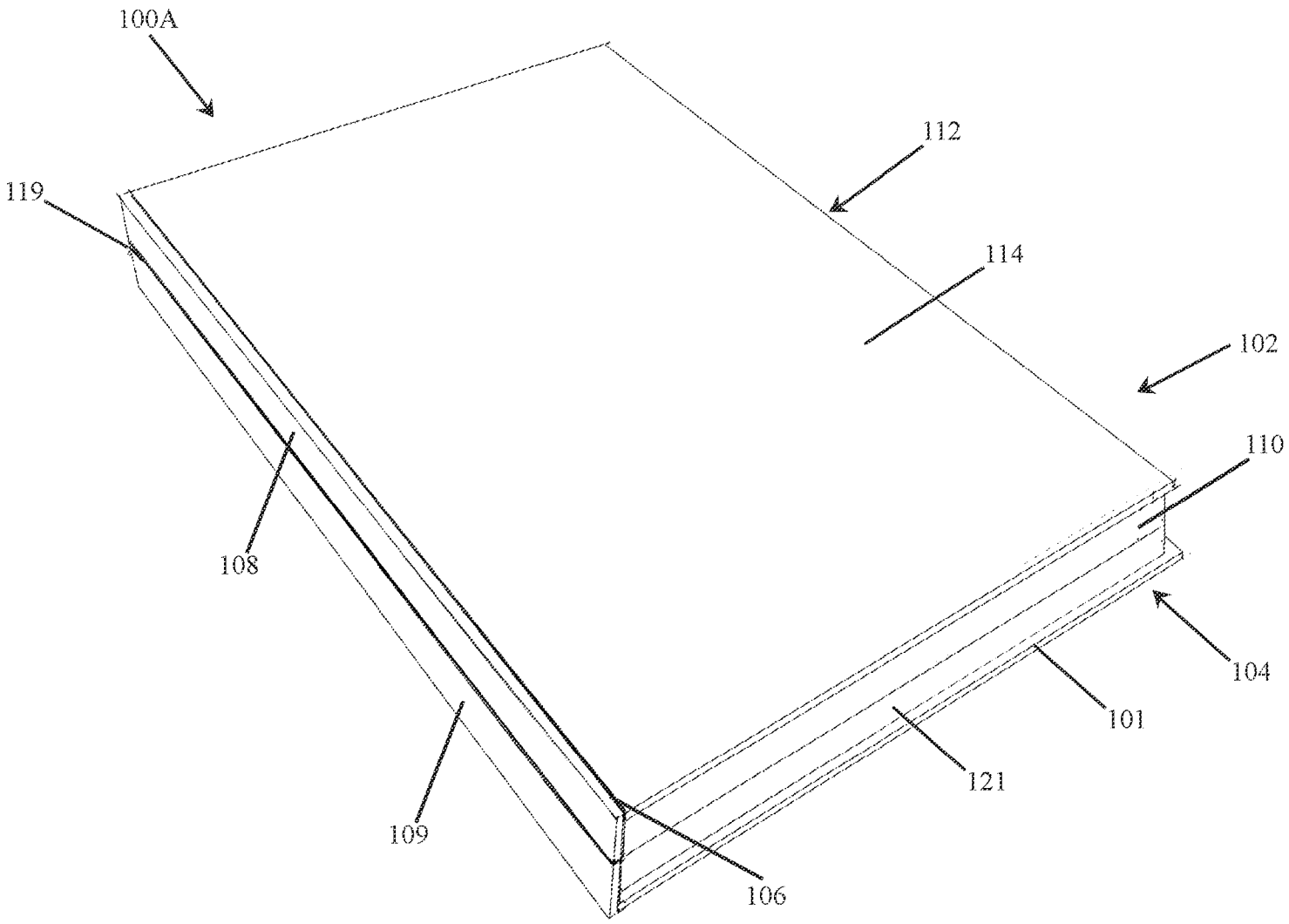
FIG. 1 illustrates an exemplary display apparatus in a closed configuration.

A pop-up display apparatus 100A that may implement one or more aspects of the technology described and illustrated herein is shown in FIG. 1 in a closed configuration. The display apparatus 100A advantageously uses the action of opening the display apparatus to lift a strut that raises and supports an easel that can be set at a variety of angles. Accordingly, the display apparatus 100A can display a stored object, and/or an object integral with the easel, at any desired angle, without direct contact with the object, and by leveraging the operation of opening the display apparatus. The display apparatus 100A can be constructed of any material including binder's board, wood, metal, plastic, or any other substantially rigid material. In some examples, the display apparatus 100A can be molded from plastic (e.g., as a monolithic plastic unit) that is rigid or semi-rigid where thick and relatively flexible where thin (e.g., at a location of various hinges), as described and illustrated in more detail below.

In this example, the display apparatus 100A has a generally rectangular shape, although the display apparatus can have any other shape in other examples. The shape, size, and construction materials for the display apparatus 100A can be selected to accommodate the size and weight of the contents of the display apparatus, including any object(s) optionally stored therein that are to be displayed upon operation of the display apparatus. In addition to such object(s), the display apparatus 100A can include other compartments or pockets, for example, for storing other object(s) (e.g., art supplies when the easel is intended to facilitate creation and display of works of art) that are not intended for display themselves. In yet other examples, the display apparatus 100A can function as a lectern without object storage, the easel itself can be embellished as a work of art, and/or the display apparatus 100A can be used to store and display books, electronic devices with display screens, and/or other types of objects, and other configurations and uses are also contemplated.

The display apparatus 100A in this particular example includes a top 102 that is coupled to a bottom 104 via a top hinge 119, which in this example is a spine extending along the length of a rear portion of the display apparatus 100A. The top hinge 119 allows rotation of the top 102 relative to the bottom 104 in order to operably open the display apparatus 100A, as described and illustrated in more detail below. Each of the top 102 and the bottom 104 includes a plurality of sides in this example. In particular, the top 102 includes a top rear side 108 and a top left side 110 extending from a front cover 112 that has an exterior surface 114 and the bottom 104 includes a bottom rear side and a bottom left side with a lower portion 121 extending from a back cover 101. The top hinge 119 in this example is disposed at an intersection of a lower portion 109 of the bottom rear side and the top rear side 108, although the top hinge 119 can be located elsewhere in other examples.

Additionally, the front cover 112 is coupled to the top rear side 108 via a front cover hinge 106 in this particular example in which the display apparatus 100A is a box with sides including the top rear side 108 and bottom rear side lower portion 109. However, in other examples, the display apparatus 100A is not a box or other container with sides and only one rear hinge is provided. In these examples, the top effectively comprises the front cover and the front cover hinge 106, which is a single rear hinge disposed at an intersection of the top and bottom portions. Also optionally, the display structure can be integral with and/or fixedly coupled to the object to be displayed. For example, the display structure can be coupled to a phone or tablet device and/or can be a screen or other computing device itself, and other configurations and uses are also contemplated.

Figure 2:
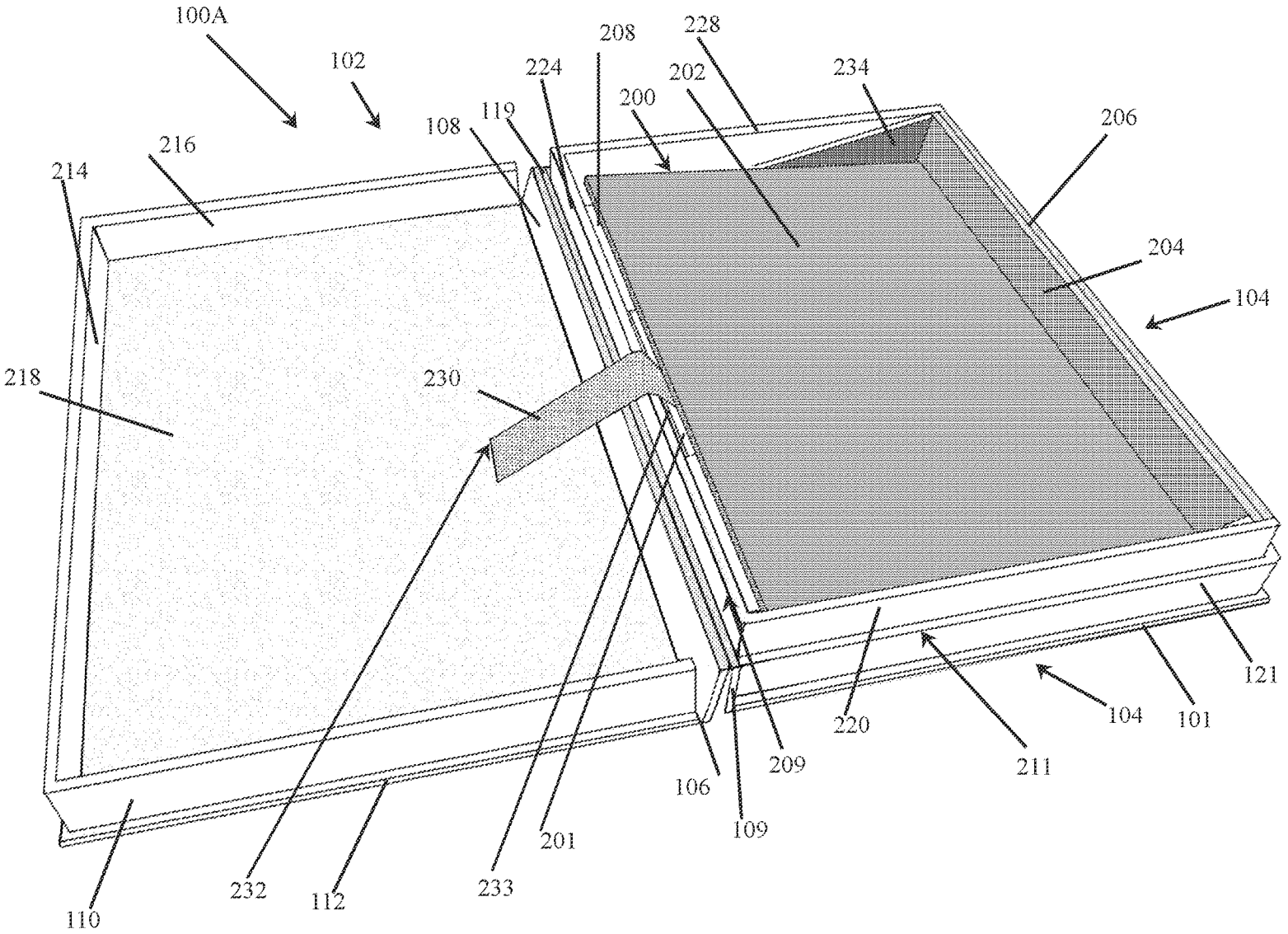
FIG. 2 illustrates an exemplary display apparatus in a partially open configuration with a top partially rotated relative to a bottom and about a top hinge.

Referring to FIG. 2, the display apparatus 100A in a partially open configuration with the top 102 partially rotated relative to the bottom 104 about the top hinge 119 is illustrated. When the top 102 is rotated about the top hinge 119 as illustrated in FIG. 2, an easel 200 is visible that includes a front surface 202 and a ledge 204. While the easel 200 is illustrated as a substantially flat or planar structure or surface in this example, the easel can be curved and/or any other type of shape or configuration in other examples. Also optionally, the easel 200 can be adjustable in one or more dimensions. The easel ledge 204 in this example extends substantially perpendicularly from the easel front surface 202 and is coupled to the bottom 104 via a easel hinge 206, although the easel ledge can extend at another angle in other examples. In particular, the easel ledge 204 is coupled to a top of an upper portion of a front side (not shown in FIG. 2) of the bottom 104 in this example, although the easel ledge can be coupled to another portion of the front side or to a different side of the display apparatus 100A.

For example, the easel ledge 204 can be coupled at one or more points along the interior surface of the bottom front side (not shown in FIG. 2) or at an intersection of the interior surface of the bottom front side and an interior surface 208 of the back cover 101. In yet other examples, the easel 200 does not include a ledge and is coupled directly to the bottom front side (not shown in FIG. 2) at any portion of the bottom front side, at an intersection of the interior surface of the bottom front side and the back cover interior surface 208, or to the back cover interior surface 208 itself. In these examples, the interior surface of the bottom front side (not shown in FIG. 2), or a portion thereof, itself can function as an easel ledge.

Alternatively, the easel 200 may not have a ledge in other examples. In one particular example, the easel 200 is coupled to the back cover interior surface 208 via the easel hinge 206, which is spaced from the bottom front side. In this example, a compartment could be disposed between the easel hinge 206 and the front side wherein a rear side of the compartment forms a ledge and the compartment provides storage (e.g., for paints, brushes, a magnifying glass, a tablet stylus, and/or other art supplies). Other configurations for the easel hinge 206 can also be used in other examples.

Accordingly, the easel 200 and a strut 201 are disposed within or contained by a chamber or compartment defined by the back cover 101 and the plurality of sides of the bottom 104, which in the example described and illustrated herein with reference to FIG. 2 extend substantially perpendicularly from the back cover interior surface 208. In addition to a bottom rear side 209 and a bottom left side 211, the bottom 104 can include a bottom front side (not shown in FIG. 2), and a bottom right side (only upper portion 228 of the bottom right side is illustrated in FIG. 2), each of which is disposed toward a perimeter of the back cover 101.

The top 102 also includes a plurality of sides that, in addition to the top rear side 108 and the top left side 110, includes a front side 214 and a right side 216, each of which is disposed toward a perimeter of the front cover 112. Each of the top front side 214, top left side 110, and top right side 216 extends substantially perpendicularly from an interior surface 218 of the front cover 112. Additionally, the top front side 214 is coupled to the top left side 110 and the top right side 216 in this particular example, although one or more of the top sides can be located elsewhere and/or coupled in other manners in other examples. However, the top rear side 108 is coupled to the front cover 112 at the front cover hinge 106 and is detached from the top left side 110 and the top right side 216 to facilitate a full opening of the display apparatus 100A, as described and illustrated in more detail below with reference to FIG. 3.

Additionally, each of the bottom sides has optional upper and lower portions in this example, and the top sides are spaced accordingly. More specifically and by way of example, the bottom left side 211 includes an upper portion 220 and a lower portion 121, the bottom rear side 209 includes an upper portion 224 and the lower portion 109, and the bottom right side includes the upper portion 228 and a lower portion (not shown in FIG. 2), with each of the lower portions disposed further towards the perimeter of the bottom 104 than the upper portions. The top front side 214, top left side 110, and top right side 216 are spaced to be disposed adjacent to the bottom front side lower portion (not shown in FIG. 2), bottom left side lower portion 121, and the bottom right side lower portion (not shown in FIG. 2), respectively, when the display apparatus 100A is in a closed configuration.

Further the top hinge 119 is disposed at an intersection of the bottom rear side lower portion 109 and the top rear side 108. In other examples, one or more of the bottom sides can have a single surface without upper and lower portions, one or more of the top sides can be spaced so as to be disposed external to a corresponding one or more of the bottom sides, the top and/or bottom sides can be excluded altogether, and other configurations can also be used in yet other examples.

Upon opening the display apparatus 100A via rotation of the top 102 about the top hinge 119, a strut tether 230 is also presented, a first end 232 of which is coupled to the front cover interior surface 218 in this example. A second end (not shown in FIG. 2) of the strut tether 230 is coupled to the strut 201. The first end 232 can be connected to the front cover interior surface 218 via tape, ribbon, wire, mechanical mechanism, or any other connection means, which can be visible or covered. While only one strut tether 230 is illustrated in this example, any number of strut tethers can be used in other examples (e.g., for redundancy, durability, and/or based on size or weight of object(s) to be displayed via the easel 200).

As tension is applied to the strut tether 230 as a result of the rotation of the top 102 about the top hinge 119, the strut 201 is rotated about a strut hinge 233 causing the strut 201 to interface with and raise the easel 200. The strut hinge 233 in this particular example is disposed proximate an intersection of the bottom rear side 209 and the back cover interior surface 208, although the easel hinge 233 can be located elsewhere on the back cover interior surface, bottom rear side, or bottom 104. One or more of the top, front cover, easel, and/or strut hinges 119, 106, 206, and 233 can be paper, cloth, plastic, another flexible material, metal, or mechanical hinges, for example, and other types of hinges can also be used.

Additionally, an optional right side support 234 is provided in this example, which is coupled to the easel 200 and disposed between the easel and the bottom right side (only the upper portion 228 of which is illustrated in FIG. 2) when the display apparatus is in a closed or partially open configuration. The right side support 234 maintains displayed objects within the easel front surface 202 and increases the strength of the easel 200. While only one side support is illustrated in FIG. 2, any number of side supports can be used in other examples. Further, any number of supports attached to the easel 200 or disposed elsewhere can also be used. For example, a top support (not shown) can be coupled to or integral with the easel 200 in order to retain an object between the top support and the easel ledge 204. Other types and/or number of supports can also be provided in other examples.

Figure 3:
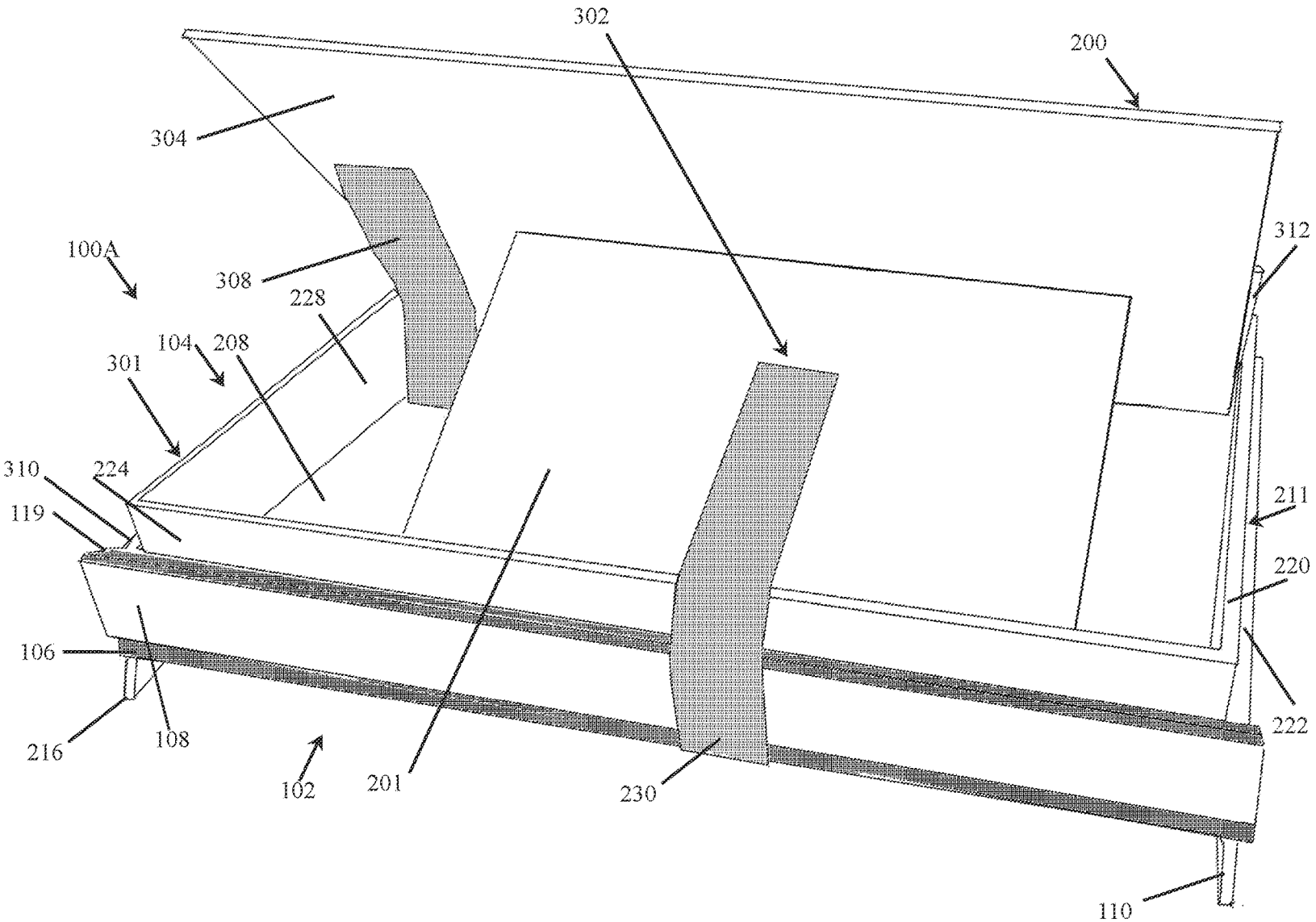
FIG. 3 is a rear view of an exemplary display apparatus in a fully open configuration with a top fully rotated relative to a bottom and about a top hinge, and a strut biased against and supporting an easel at a particular display angle.

Referring to FIG. 3, a rear view illustrating the display apparatus 100A in a fully open configuration with the top 102 fully rotated about the top hinge 119 and the front cover hinge 106 and the strut 201 biased against and supporting the easel 200 at a particular display angle is illustrated. A second end 302 of the strut tether 230 is coupled to the strut 201 (e.g., at a rear surface) in this example. The second end 302 can be coupled to the strut 201 in the same or a different manner as the first end 232 is coupled to the front cover interior surface 218. While the strut 201 is illustrated as a substantially flat board in this example, the strut can be a rod or other structure that is fixed or telescoping in other examples. Additionally, the strut 201 can be in a fixed position or movable to facilitate adjustment of the display angle of the easel 200.

Accordingly, as the front cover 112 is rotated about the front cover hinge 106, the strut 201 is rotated about the strut hinge 233 via tension placed on the strut tether 230. In other words, the strut 201 is configured to rotate about the strut hinge 233, to cause the easel 201 to rotate about the easel hinge 206, when the front cover 112 is rotated about the front cover hinge 106 (after the top 102 is rotated about the top hinge 119) as a result of the tension placed on the strut tether 230. The tension is placed on the strut tether 230 as a result of the rotation of the front cover 112 about the front cover hinge 106 to thereby bias the strut 201 against a back surface 304 of the easel 200.

Optionally, the front cover exterior surface 114 is disposed adjacent (e.g., in contact with) and substantially parallel to an exterior surface (not shown) of the back cover 101 when the front cover 112 is fully rotated about the front cover hinge 106, the top rear side 108 is rotated about the top hinge 119, and the display apparatus 100A is in a fully open configuration. In the fully open configuration in this example, the display apparatus 100A can be supported by the top front side 214, top left side 110, and top right side 216.

Additionally, the easel back surface 304 is disposed toward the back cover interior surface 208 with the strut 201 disposed between the easel back surface and the back cover interior surface 208 in this example. Accordingly, the length of the strut tether 230 and dimensions of the strut 201 can define the display angle of the easel 200. For example, a shorter strut tether 230 may result in a more acute display angle defined based on the easel back surface 304 and the back cover interior surface 208.

An optional easel tether 308 is also provided in the example display apparatus 100A illustrated in FIG. 3. The easel tether 308 can be flexible or rigid and is coupled to the easel back surface 304 and the back cover interior surface 208 and disposed between the strut 101 and the bottom right side 301, which includes the upper portion 228 and a lower portion 310. The easel tether 308 has a length configured to limit the rotation of the easel 200 about the easel hinge 206 to prevent the easel from over-rotation, which could dislodge the object(s) to be displayed by the easel, for example. While only one easel tether 308 is illustrated in FIG. 3, any number of easel tethers can be provided in other examples. Additionally, an optional left side support 312 is disposed opposite the right side support 234 and is coupled to the easel 200 in the same manner as the right side support.

Figure 4:
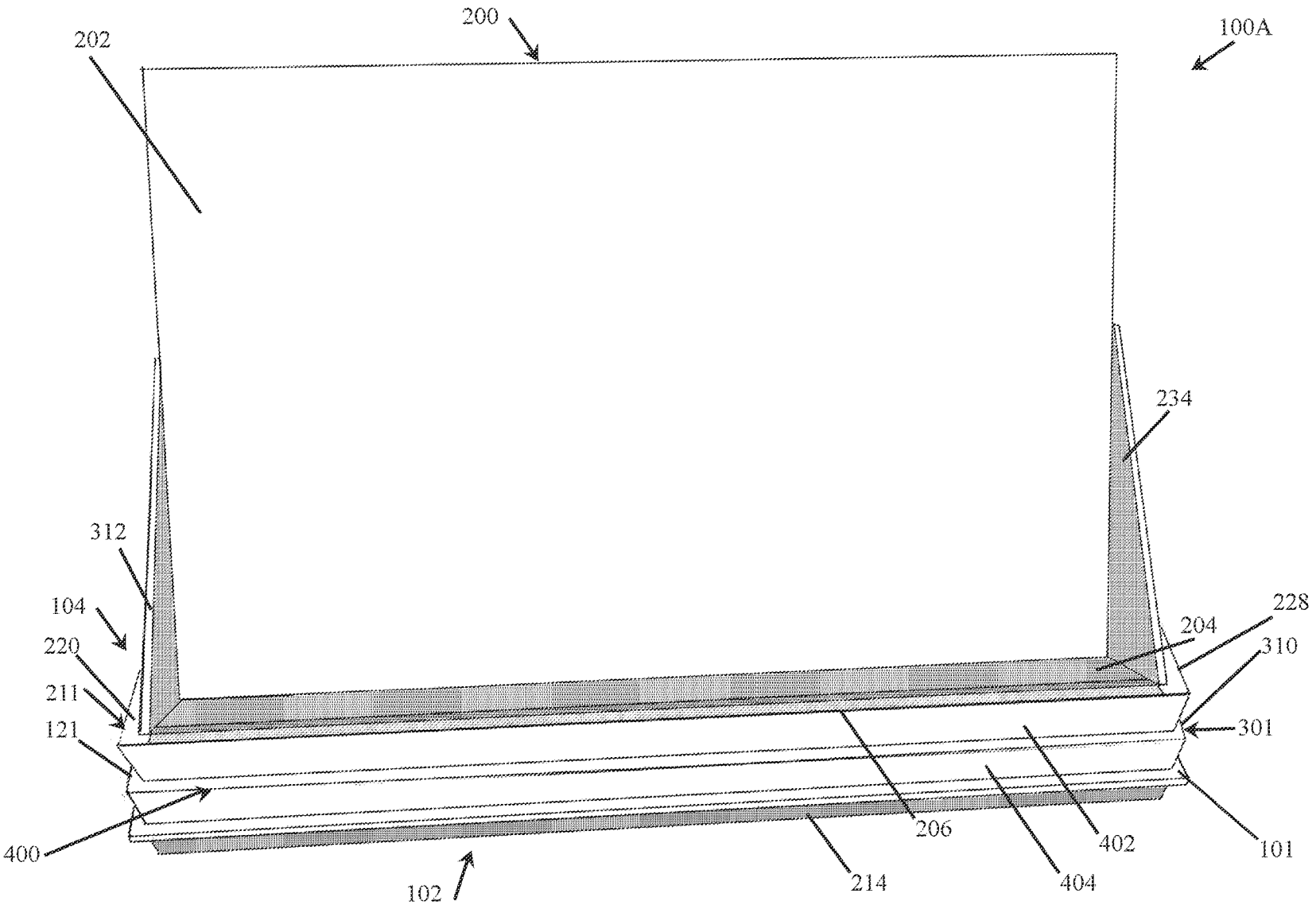
FIG. 4 is a front view of an exemplary display apparatus in a fully open configuration with an easel disposed at a particular display angle.

Referring to FIG. 4, a front view of the display apparatus 100A in a fully open configuration with the easel 200 disposed at a particular display angle is illustrated. In this example, the display apparatus 100A is in the fully open configuration shown in FIG. 3 such that the strut 201 is supporting the easel 200 and object(s) contained within the chamber of the display apparatus 100A would automatically be supported by the easel 200 within the easel ledge 204, left side support 312, and right side support 234 when the display apparatus is opened.

Accordingly, as the display apparatus 100A is opened, and the front cover 112 is rotated about the front cover hinge 106, tension is placed on the strut tether 230, which rotates the strut 201 about the strut hinge 233 biasing the strut 201 against, and thereby raising and supporting, the easel 200, which is rotated about the easel hinge 206. As explained above, and illustrated in FIG. 4, the easel hinge 206 in this example is disposed at an intersection of the easel ledge 204 and a front side 400 of the bottom 104. In this particular example, the bottom front side 400 includes an upper portion 402 and a lower portion 404 and the easel hinge 206 is located at an intersection of the bottom front side upper portion 402 and the easel ledge 204, although the easel hinge can be located elsewhere on the bottom 104, bottom front side 400, and/or easel 200.

Figure 5:
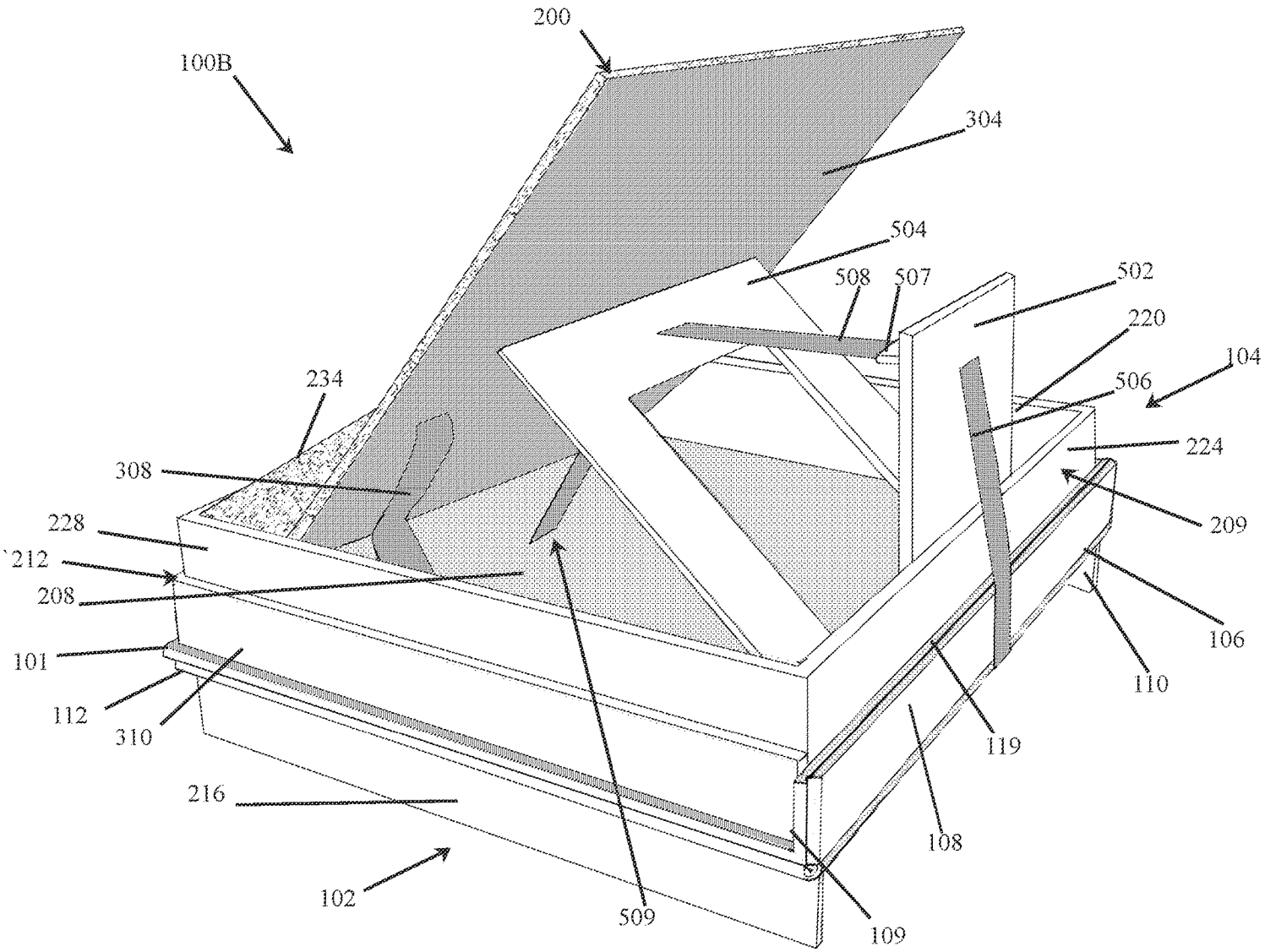
FIG. 5 illustrates an exemplary display apparatus with multiple struts and multiple strut tethers in a fully open configuration.

Referring to FIG. 5, another exemplary display apparatus 100B with a first strut 502, a second strut 504, a first strut tether 506, a second strut tether 508, and a strut stop 507 in a fully open configuration is illustrated. In this example, the display apparatus 100B includes the first and second struts 502 and 504 for strength In this particular example, rotation of the front cover 112 about the front cover hinge 106 supplies tension to the first strut tether 506 that is coupled to the top 102 and the first strut 502, which further supplies tension to the second strut tether 508 coupled to the first strut 502 at the strut stop 507 and the second strut 504.

Accordingly, in this example, the strut tether 506 is a continuous material that extends through a first slot in the first strut 502 and a second slot in the second strut 504. While the first and/or second struts 502 and 504 may be fixed in position in some examples, in this particular example the strut stop 507 prevents the strut 508 from pulling through the first slot in the first strut 502 when tension is applied by rotation the front cover 101. Accordingly, the strut stop 507 may be fixed in position or adjustable to control the angle of the easel 200. While only strut stop 507 is illustrated in FIG. 5, another strut stop could be provided between an end 509 of the second strut tether 508 and the second strut 504, and other configurations could also be used.

As a result of the tension supplied to the first strut tether 506, the first strut 502 is rotated about a first portion of the strut hinge 233. Additionally, as a result of the tension supplied to the second strut tether 508, the second strut 504 is rotated about a second portion of the strut hinge 233. In some examples the first and second portions of the strut hinge 233 are separate hinges sharing a same long axis, although other configurations for facilitating rotation of the first strut 502 and/or the second strut 504 can employ hinge(s) in different locations. When the second strut 504 is rotated about the second portion of the strut hinge 233, it is biased against the easel back surface 304 to thereby raise the easel 200 as it rotates about the easel hinge 206. The end 509 of the second strut tether 508 limits the motion of the second strut 504 and can be attached in any of the ways described above with reference to the strut tether 230.

Figure 6:
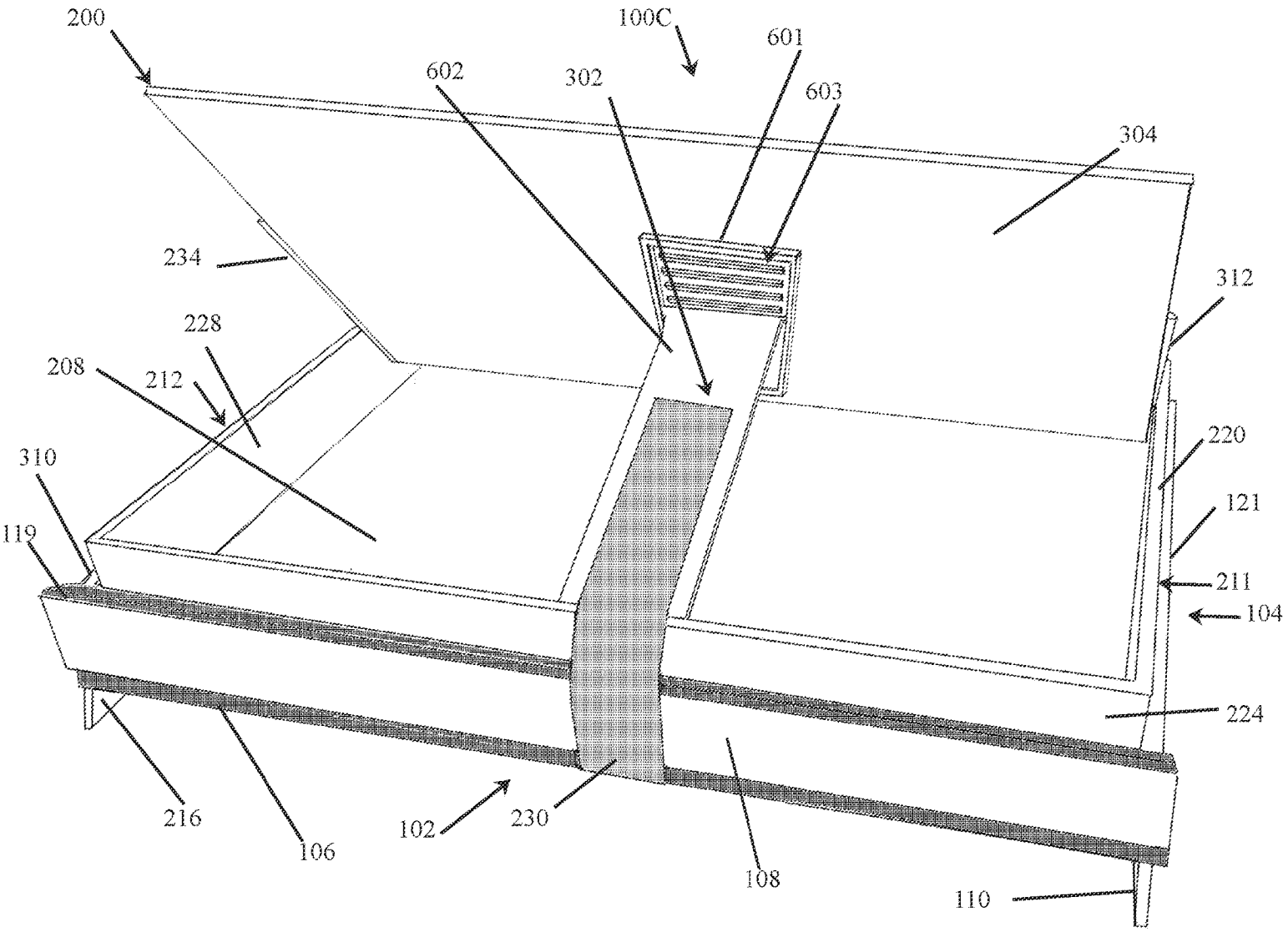
FIG. 6 illustrates an exemplary display apparatus with a track and in a fully open configuration.

Referring to FIG. 6, yet another exemplary display apparatus 100C with a track 601 and in a fully open configuration is illustrated. The display apparatus 100C in this example includes the track 601, coupled to or integral with the easel back surface 304, and a track strut 602 configured to translate within the track 601 as a result of tension supplied to the strut tether 230. The translation of the track strut 602 within the track 601 causes the easel 200 to rotate about the easel hinge 206. Optionally, the track 601 can have one or more integral track stops 603 with which the track strut 602 is configured to engage to establish a desired display angle of the easel 200. Also optionally, the track strut 602 can be configured to rotate a particular amount about the strut hinge 233, with further rotation being facilitated manually by lifting the track strut and the easel 200 to obtain a desired display angle based on engagement of one of the track stops 603.

With this technology, a pop-up display apparatus is provided that advantageously stores object(s) that can be displayed by an easel contained by the display apparatus as a result of opening the display apparatus by rotating the top relative to a bottom and about a hinge. Accordingly, object(s) stored in the display apparatus can be displayed via the easel without any direct contact with the object(s). Additionally, any number of display angles for the easel can be facilitated automatically or manually based on the support of the easel by a strut of the display apparatus. Moreover, object storage and transport is improved, and object display is facilitated more efficiently and effectively with this technology, without requiring any assembly of parts into an easel or other display device.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A display apparatus, comprising:

a top coupled to a bottom, wherein the top comprises a front cover and a front cover hinge and the bottom comprises a back cover;

an easel coupled to the bottom via an easel hinge, wherein the easel comprises a back surface disposed toward an interior surface of the back cover;

at least one strut coupled to the bottom via a strut hinge and disposed between the easel back surface and the back cover interior surface; and at least one strut tether coupled to the at least one strut and another interior surface of the front cover, wherein the at least one strut is configured to rotate about the strut hinge, to cause the easel to rotate about the easel hinge, when the front cover is rotated about the front cover hinge.

2. The display apparatus of claim 1, wherein the top is coupled to the bottom via the front cover hinge.

3. The display apparatus of claim 1, wherein:

the top is coupled to the bottom via a top hinge;

the top further comprises a plurality of top sides including a top rear side coupled to the front cover via the front cover hinge; and the front cover is configured to rotate about the front cover hinge after the top is rotated about the top hinge.

4. The display apparatus of claim 3, wherein:

the top sides further comprise top front, left, and right sides that extend substantially perpendicularly from the front cover interior surface;

the top front, left, and right sides are disposed toward another perimeter of the front cover; and the top front side is coupled to the top left and right sides and the top rear side is detached from the top left and right sides.

5. The display apparatus of claim 1, wherein:

the bottom further comprises a plurality of bottom sides disposed toward a perimeter of the back cover and comprising a bottom front side; and the easel is coupled to the bottom front side via the easel hinge.

6. The display apparatus of claim 5, wherein:

the top hinge comprises a spine extending along at least a portion of a length of a bottom rear side of the bottom sides; and the front cover hinge allows rotation of the front cover such that an exterior surface of the front cover is disposed adjacent and substantially parallel to another exterior surface of the back cover.

7. The display apparatus of claim 5, wherein the bottom sides further comprise a bottom rear side disposed opposite the bottom front side and the strut hinge is disposed proximate an intersection of the bottom rear side and the back cover interior surface.

8. The display apparatus of claim 5, wherein the easel further comprises:

one or more supports; and an easel ledge that extends substantially perpendicularly from a front surface of the easel and is coupled to the bottom front side via the easel hinge.

9. The display apparatus of claim 5, wherein each of the bottom sides extends substantially perpendicularly from the back cover interior surface and the bottom sides collectively define a chamber within which the easel and the at least one strut are disposed.

10. The display apparatus of claim 5, wherein the bottom sides further comprise a bottom rear side disposed opposite the bottom front side and opposing bottom left and right sides disposed between and coupled to the bottom front and rear sides.

11. The display apparatus of claim 5, wherein each of the bottom sides comprises an upper portion and a lower portion and the lower portion is disposed further towards the perimeter than the upper portion.

12. The display apparatus of claim 1, further comprising at least one easel tether coupled to the easel back surface and the back cover interior surface and having a length configured to limit the rotation of the easel about the easel hinge.

13. The display apparatus of claim 1, wherein rotation of the front cover about the front cover hinge is configured to supply tension to the at least one strut tether to thereby bias the at least one strut against the easel back surface.

14. The display apparatus of claim 1, wherein the at least one strut comprises a first strut and a second strut, the at least one strut tether comprises a first strut tether and a second strut tether, the first strut tether is coupled to the first strut and the front cover interior surface, and the second strut tether is coupled to one or more of the first strut, second strut, or back cover interior surface.

15. The display apparatus of claim 14, further comprising at least one strut stop configured to restrict movement of at least one of the first or second strut tethers through a first slot or a second slot in the first or second struts, respectively.

16. The display apparatus of claim 1, wherein the at least one strut is further configured to rotate about the strut hinge to contact the easel back surface, and thereby cause the easel to rotate about the easel hinge, when the front cover is rotated about the front cover hinge.

17. The display apparatus of claim 1, wherein the at least one strut is coupled to the easel back surface via a track and is configured to translate within the track when the at least one strut is rotated about the strut hinge.

18. The display apparatus of claim 17, wherein the track is coupled to or integral with the easel back surface and comprises a plurality of track stops configured to engaged the at least one strut and thereby maintain a display angle of the easel.

19. A display apparatus, comprising:

a top coupled to a bottom via a top hinge, wherein the top comprises a front cover and a plurality of top sides including a top rear side coupled to the front cover via a front cover hinge and the bottom comprises a back cover coupled to a plurality of bottom sides disposed toward a perimeter of the back cover and comprising a bottom front side;

an easel comprising an easel ledge coupled to the front side via an easel hinge, wherein the easel comprises a back surface disposed toward an interior surface of the back cover;

at least one strut coupled to the bottom via a strut hinge and disposed between the easel back surface and the back cover interior surface; and at least one strut tether coupled to the at least one strut and another interior surface of the front cover, wherein the at least one strut is configured to rotate about the strut hinge to contact the easel back surface, and thereby cause the easel to rotate about the easel hinge, when the top is rotated about the top hinge and the front cover is rotated about the front cover hinge.

20. A display apparatus, comprising:

a top coupled to a bottom via a top hinge, wherein the top comprises a front cover and a plurality of top sides including a top rear side coupled to the front cover via a front cover hinge and the bottom comprises a back cover coupled to a plurality of bottom sides disposed toward a perimeter of the back cover and comprising bottom front and rear sides and bottom left and right sides disposed between and coupled to the bottom front and rear sides;

an easel coupled to the bottom front side via an easel hinge, wherein the easel comprises a back surface disposed toward an interior surface of the back cover;

at least one strut coupled to the bottom via a strut hinge, wherein the bottom sides collectively define a chamber within which the easel and the at least one strut are disposed when the display apparatus is in a closed configuration; and at least one strut tether coupled to the at least one strut and another interior surface of the front cover, wherein, after the top is rotated about the front cover, rotation of the front cover about the front cover hinge is configured to supply tension to the at least one strut tether to cause the at least one strut to rotate about the strut hinge and thereby bias the at least one strut against the easel back surface to cause the easel to rotate about the easel hinge.

* * * * *